US005137504A

United States Patent [19]

Mangini

[11] Patent Number: 5,137,504

[45] Date of Patent: Aug. 11, 1992

[54] STRETCHING MACHINE

[76] Inventor: Vincent W. Mangini, Box #2, Crabtree, Pa. 15624

[21] Appl. No.: 709,054

[22] Filed: Jun. 3, 1991

[51] Int. Cl.[5] ..... A63B 21/00

[52] U.S. Cl. ..... 482/131; 482/133; 482/134; 482/907

[58] Field of Search ..... 272/126, 127, 903, 134, 272/144

[56] References Cited

U.S. PATENT DOCUMENTS

| | | | |
|---|---|---|---|
| 4,022,463 | 5/1977 | Scott, Jr. . | |
| 4,149,713 | 4/1979 | McLeon . | |
| 4,277,062 | 7/1981 | Lawrence . | |
| 4,456,247 | 6/1984 | Ehrenfried . | |
| 4,647,040 | 3/1987 | Ehrenfried . | |
| 4,819,936 | 4/1989 | Muller | 272/126 |
| 4,844,453 | 7/1989 | Hestilow . | |
| 4,877,239 | 10/1989 | Dela Rosa . | |
| 4,892,304 | 1/1990 | DeNiro | 272/903 |
| 5,026,049 | 6/1991 | Goodman | 272/126 |

OTHER PUBLICATIONS

"Ultrastretch" Brochure, *Black Belt*, Feb. 1987.

*Primary Examiner*—Richard J. Apley
*Assistant Examiner*—Lynne Reichard
*Attorney, Agent, or Firm*—Walter J. Blenko, Jr.; David V. Radack

[57] ABSTRACT

A stretching machine comprising a seat having a base and a backrest which is pivotally mounted to the base, a first leg platform having a pivot end and a free end, the pivot end being connected to the base of the seat and a second leg platform having a pivot end and a free end, the pivot end being connected to the base of the seat. The stretching machine includes a mechanism for rotating the backrest relative to the seat as well as a mechanism for rotating the leg platforms about their respective pivot ends such that the free ends move in a generally arcuate path.

11 Claims, 2 Drawing Sheets

STRETCHING MACHINE

BACKGROUND OF THE INVENTION

1. Field of the Invention

My invention relates to a stretching machine that effectively and efficiently stretches the leg and back muscles. More particularly, this invention provides a seat having a pivotally mounted backrest and a pair of leg platforms pivotally mounted to the seat.

2. Description of the Related Art

In several sports activities, especially the martial arts, it is important to be able to perform kicks and other maneuvers which require extreme movement of various muscle groups. It is incumbent upon participants in these sports to adequately stretch muscle groups such as the hamstrings, quadriceps, adductors, abductors, groin, hip, gluteal and lower and lumbar regions in the back.

U.S. Pat. Nos. 4,456,247 and 4,647,040 disclose a leg stretching apparatus in which a person sits in a seat and places his legs on two separate platforms. The person's legs are spread through the action of a crank and crank assembly. The seat assembly is comprised of two generally planar portions. The planar portions have wooden dowels which protrude from their lower end and which engage holes in the base assembly of the seat. It is said that this controls both the position and tilt of the seat to suit the person's need.

U.S. Pat. Nos. 4,277,062; 4,844,453 and 4,877,239 also disclose leg stretching machines.

In addition, a leg stretching machine sold under the trade name ULTRASTRETCH by Ultrastretch of Portland, Oregon shows a leg stretching machine with a steering wheel device that operates to spread the legs of a person who is sitting on the seat thereof. A spring knob is provided to allow the backrest of the seat to pivot into five different positions.

Despite these leg stretching machines, there remains a need for a machine that not only stretches the leg muscles but which also, at the same time, stretches the muscles of the lower back. This machine would not only stretch these muscles but would also provide a synergistic effect to stretch the hamstring and groin muscles further than would be possible than with machines concentrating on one muscle group or the other.

SUMMARY OF THE INVENTION

I provide a leg stretching machine having a seat with a generally horizontal base portion and a generally perpendicular backrest which is pivotally mounted to the base portion. I further provide a pair of leg platform means each having a pivot end and a free end, the pivot ends being connected to the base. I then further provide means for rotating the backrest relative to the base portion and means for rotating the platform means about their respective pivot ends such that the free ends move in a generally arcuate path.

BRIEF DESCRIPTION OF THE DRAWINGS

In the accompanying drawings I have illustrated a present preferred embodiment of my invention in which.

DESCRIPTION OF THE PREFERRED EMBODIMENT

Figure 1:
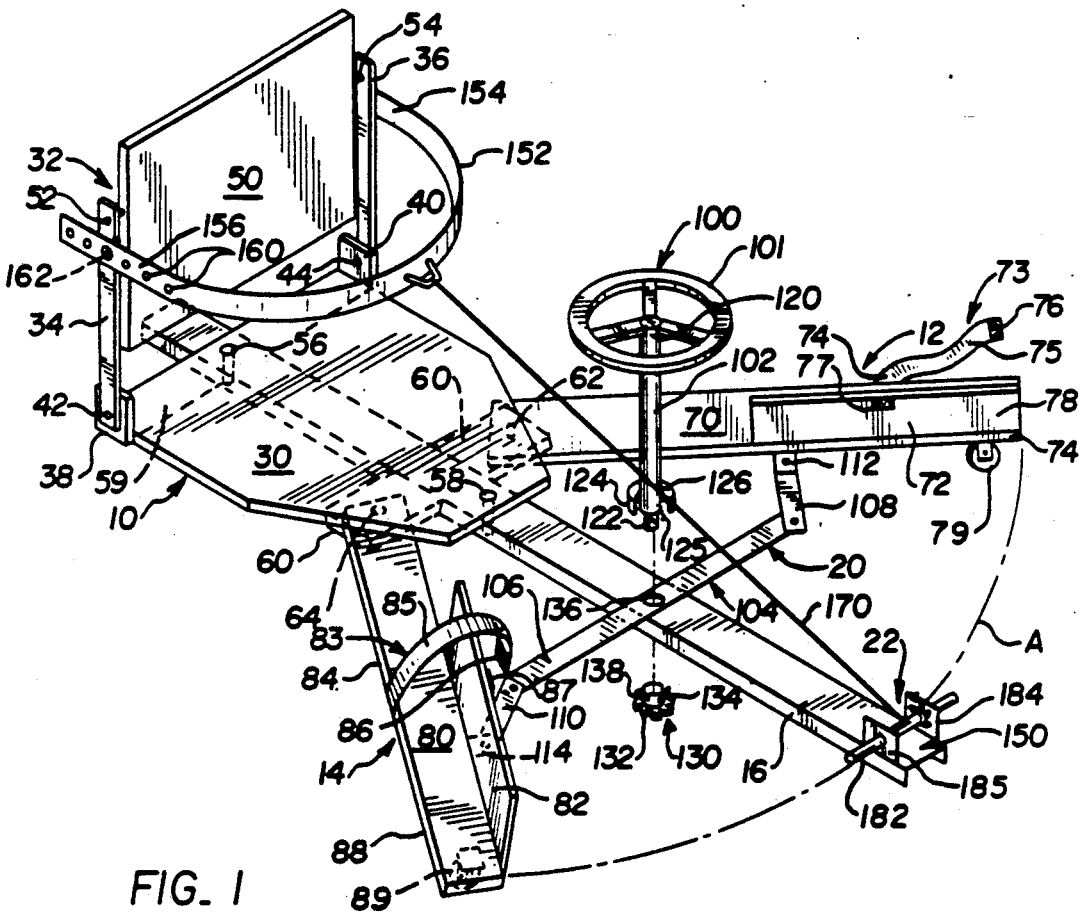
FIG. 1 is a perspective view with the steering wheel means shown in an exploded view, of a stretching machine embodying my invention.

Referring more particularly to FIG. 1, there is shown a typical embodiment of my stretching machine. The machine consists of seat assembly 10, a first leg platform 12, a second leg platform 14 and a central post 16. Means for rotating the leg platforms 20 is provided along with means for rotating the seatback 22.

The seat assembly 10 consists of a generally horizontal base portion 30 and a generally vertical backrest assembly 32 which is pivotally mounted to the base portion 30. The backrest assembly 32 is shown as two posts 34 and 36 which are pivotally mounted to respective blocks 38 and 40 which are in turn fixedly mounted to the base portion 30 as by welding. The posts 34 and 36 are pivotally mounted to the blocks 38 and 40 by respective nut and bolt sets 42 and 44. The backrest assembly 32 further includes a generally planar vertically mounted portion 50 that is also pivotally mounted to the posts 34 and 36 by means of screws 52 and 54 which are inserted through the posts 34 and 36 and into portion 50.

The base portion 30 in the form shown is a truncated octagon and is fixedly mounted on the central post 16 by means of nut and bolt assemblies 56 and 58. Also underlying the base portion 30 is a cross member 59. The central post 16 includes a cross member 60 which is integral thereto and which is positioned generally perpendicularly to the post 16. The first leg platform 12 is pivotally mounted on one end portion of the cross member 60 by nut and bolt assembly 62 and the second leg portion 14 is pivotally mounted on the other end portion 64 of the cross member 60 by nut and bolt assembly 64.

The first leg portion 12 extends from the base portion 30 and cross member 60 and includes a horizontal longitudinally extending platform 70 and a vertical longitudinally extending wall 72. A Velcro strap 73 is provided having one end 74 connected to the platform 70 and a free end 75 with Velcro fasteners 76 on its underside. The extending wall 72 has Velcro hooks 77 mounted thereon. This strap 73, when wrapped around the users leg and hooked to the extending wall 72, along with the extending wall 72 will maintain the leg of the user in a spread position during operation of the machine. The free end 78 of the platform 70 has mounted on its underside a wheel assembly 79 which will facilitate rotation of the first leg platform 12.

The second leg portion 14 extends from the base portion 30 and cross member 60 and includes a horizontal longitudinally extending platform 80 and a vertical longitudinally extending wall 82. A Velcro strap 83 is also provided for this leg platform 80 having one end 84 connected to the platform 80 and a free end 85 with Velcro fasteners 86 on its underside. The extending wall 82 has Velcro hooks 87 mounted thereon. This strap 83, when wrapped around the user's leg and hooked to the extending wall 82, along with the extending wall 82 will also maintain the leg of the user in a spread position during operation of the machine. The free end 88 of the platform 80 has mounted on its underside a wheel assembly 89 which will facilitate rotation of the second leg platform 14.

The means for rotating the leg platforms 20 consists of a steering wheel means 100 consisting of a wheel 101 fixedly mounted to a post 102 which operates a pivot mechanism 104. The pivot mechanism consists of a central bar 106 and two arms 108 and 110 pivotally mounted to each end of the central bar 106. The two arms are in turn mounted to respective anchors 112 and 114 that are fixedly mounted to the respective first and second leg portions 12 and 14.

The steering wheel means 100 operates the pivot mechanism 104 as is shown in the exploded perspective view in FIG. 1. The steering wheel 101 is fixedly mounted at the top end 120 of the post 102. The bottom end of the post 102 is formed with a key portion 122. A cylindrical sleeve 124 having open end 125 is fixedly welded to the exterior of the bottom of the post 102 at annular area 126 of the post. The sleeve 124 will act to cover the key portion 122 of the post 102 as well as facilitate maintaining the post in an upright position.

A ratchet means 130 consisting of a ratchet gear 132 which is welded to a shaft 134 extends through central post 16, and central bar 106 by means of hole 136, with the shaft 134 fitting into hole 136 in the central bar 106 and protruding therefrom. The shaft 134 is welded to the central bar 106. The shaft 134 protrudes upwardly from the central bar 106 about one inch after it is welded to the central bar 106. Shaft 134 defines a key way 138 which is sized and shaped to be complementary to key portion 122 of the post 102 and which is adapted to receive the key portion 122 of the post. In operation, turning the wheel 101 will in turn rotate the post 102 and key portion 122. Because key portion 122 is disposed in key way 138, the ratchet means 130 will cause the central bar 106 to rotate thus moving the arms 108 and 110 to move the leg portions 12 and 14 such that the free ends 78 and 88 of the leg portions, with the help of wheel assemblies 79 and 89, move in a generally arcuate path as indicated by the dotted line labelled "A" in FIG. 1.

Figure 2:
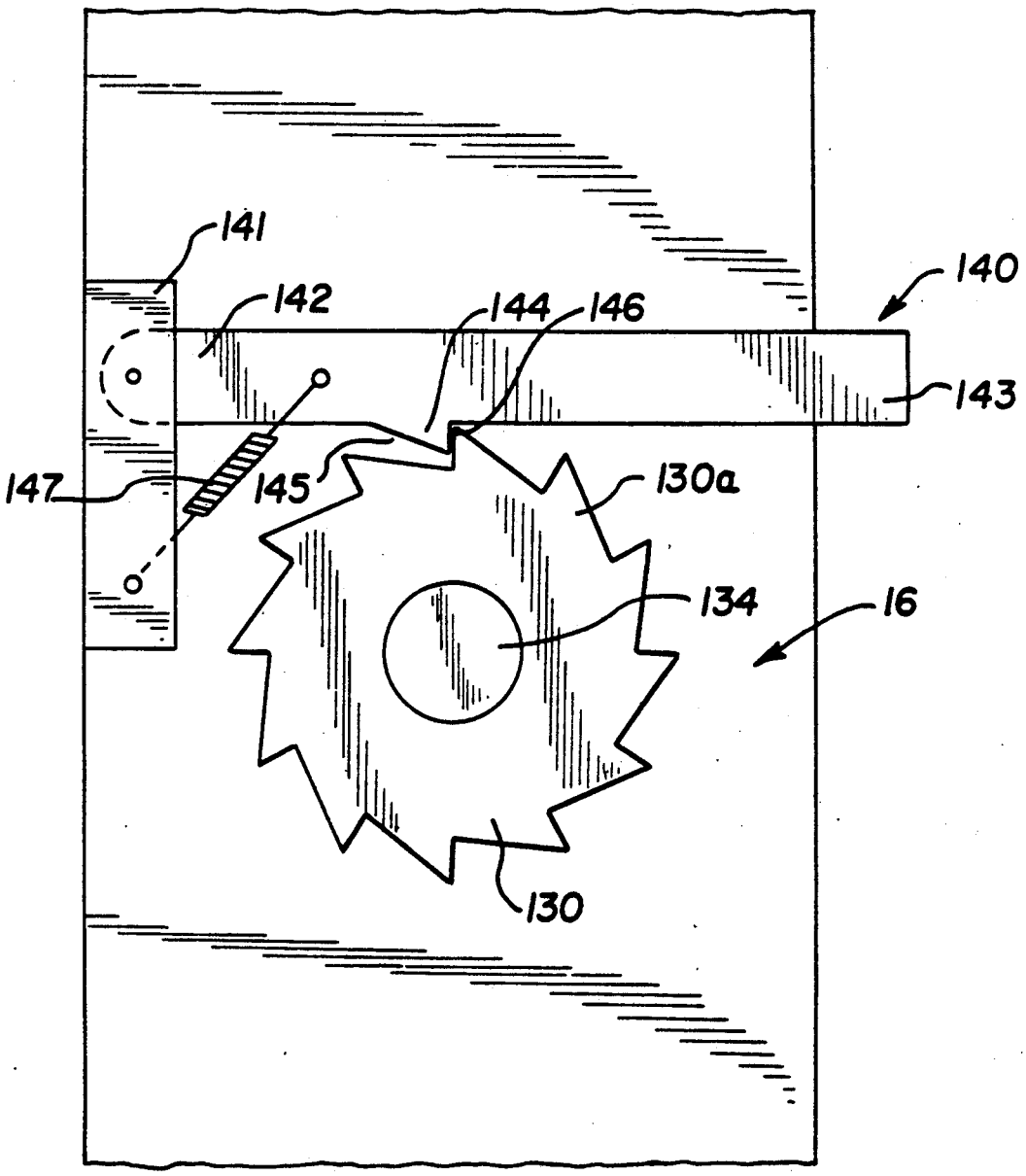
FIG. 2 is a detailed bottom plan view of the release mechanism associated with the steering wheel and pivot mechanism of the stretching machine.

FIG. 2 shows the ratchet release mechanism 140 associated with the ratchet gear 130. The ratchet release mechanism consists of a fixed bar 141 which is mounted on the central post 16 and a release bar 142 which protrudes out from under the central post 16 at section 143 thereof in order that a user can gain access to the release mechanism 140. The release bar 142 has portion 144 consisting of a bevelled edge 145 and a straight edge 146. The release bar 142 is spring biased against the ratchet 130 by a spring 147.

In operation, portion 144 engages the teeth 130*a* of the ratchet 130. The clockwise (as seen in this view) rotation of the ratchet will cause the portion 144 and bar 142 to ride over the teeth 130*a* of the ratchet 130. Because of the configuration of portion 144 and teeth 130*a*, the shaft 134 and ultimately the steering wheel 100 to which the shaft 134 is connected can be rotated clockwise (in this view) but will be prevented from rotating counterclockwise. In this way, the leg platforms 12 and 14 can be moved away from each other in the arcuate path "A" but will be resisted from suddenly being forced to the closed position. In order to obtain a counterclockwise and thus closing of the leg platforms, the bar is simply pulled away from the ratchet by engaging section 143 and lifting portion 144 away from the ratchet teeth 130*a*. In this way, injury to the user is avoided.

Figure 3:
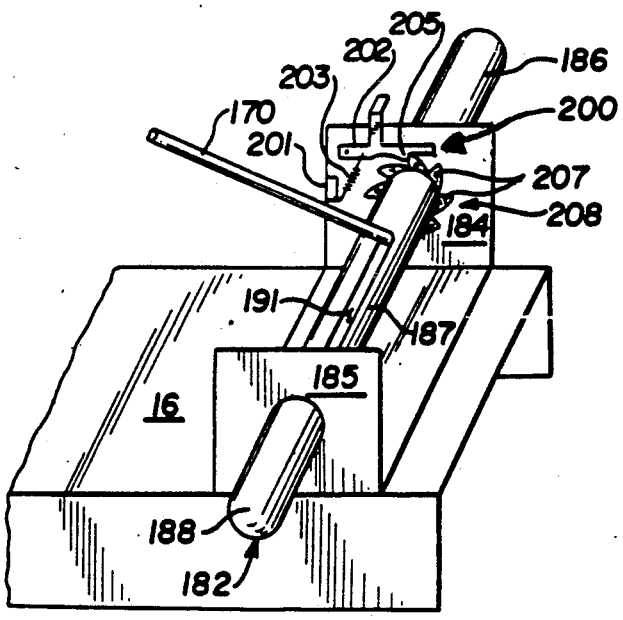
FIG. 3 is a detailed view of the seat rotating means embodying my invention.

Referring now to both FIGS. 1 and 3, the means 22 for rotating the backrest 32 relative to the base portion 30 is shown. The rotation means 22 includes a restraining strap 152 having one end 154 fixedly mounted to post 36 and another end 156 which can be selectively mounted on post 34 to accommodate different sized users in the machine. End 156 can have a series of snaps 160 that can engage a buckle 162 on post 34. Connected to strap 152 is a cord means 170 that is connected to the handle means positioned at the front of the central post 60.

As can be seen in FIG. 3, a rod 182 is rotatably mounted between two flanges 184 and 185 which extend vertically upward from the central post 16. The rod 182 has a left portion 186 that extends beyond flange 184, a central portion 187 that receives the cord 170 and a right portion 188 that extends beyond flange 185. The right and left portions 186 and 188 are long enough to facilitate a user grasping the respective portions with the left and right hands. The central portion 187 is shown having a longitudinal slot 191 which acts to firmly secure one end of the cord thereto.

Upon rotation of the rod 172 by a user grasping portions 186 and 188, the cord 170 is wound onto the rod 182 and the cord 170 acts to pull the backrest 32 towards the front of the machine, thus causing the user to assume a bent over posture. It will be appreciated that the user can rotate the backrest 32 while his legs are in any position on the machine. There is no need to get off of the machine to change the orientation of the backrest 32 relative to the base 30. The simultaneous stretching of the legs and back creates a synergistic effect which provides greater flexibility to the leg and back muscles than could be obtained if these muscles were stretched separately.

Another feature of the rotation means is the provision of a ratchet and pawl mechanism 200. As seen particularly in FIG. 3, the ratchet and pawl mechanism 200 consists of a bar 201 that is oriented generally vertically and a pawl 202 which is pivotally mounted to the bar 201 and in a generally perpendicular relationship to the bar 201. The pawl 202 and the bar 201 are connected further by a spring 203. A portion 205 of the pawl 202 engages the teeth 207 of the ratchet 208, the ratchet 208 being mounted on the rod 182 and able to rotate with the rotation of the rod 182. In operation the clockwise rotation of the rod 182 will cause the clockwise rotation of the ratchet 208. The pawl 200 with portion 205 will ride over the teeth of the ratchet 207. Because of the configuration of the pawl portion 205 and the teeth 207 of the ratchet 208, the rod 182 can be rotated clockwise but will be prevented from rotating counterclockwise. This will, in turn, assure that the backrest 32 stays in a pivoted downwardly position while the user is bent over stretching the back muscles. The ratchet and pawl means 200 provide an unlimited number of backrest 32 positions. The backrest 32 can be released by merely unhooking the spring 203 from the bar 201 and lifting the pawl 202 so that portion 205 is clear of the ratchet teeth 207. This will permit free counterclockwise rotation of the rod 182 without interference from the ratchet 208.

While I have illustrated and described a present preferred embodiment of the invention, it is to be understood that the invention is not limited thereto and may be otherwise variously practiced within the scope of the following claims.

I claim:

1. A stretching machine comprising:

seat means including a generally horizontal base portion and a generally perpendicular backrest which is pivotally mounted to said base;

first leg platform means having a pivot end and a free end, said pivot end being pivotally connected to said base;

second leg platform means having a pivot end and a free end, said pivot end being pivotally connected to said base;

means for rotating said backrest relative to said base portion;

means for rotating said platform means about their respective pivot ends such that said free ends move in a generally arcuate path; and said backrest rotation means includes (i) a belt mounted on said backrest which is adapted to be wrapped around the user of said machine; (ii) a rotatable rod means mounted on the end of the stretching means opposite said seat means; and (iii) a cord connected to said belt and adapted to be wrapped around said rotatable rod, whereby rotating said rod will wrap said cord therearound and in turn will rotate said backrest relative to said base portion.

2. The stretching machine of claim 1, wherein said rotatable rod means includes a pair of flanges mounted on either side of said central post; a rod rotatably mounted between said flanges, said rod extending outwardly from both of said flanges to facilitate a user grasping and rotating said rod; and a ratchet and pawl means operatively associated with said rod.

3. The stretching machine of claim 2, wherein said ratchet and pawl means includes a ratchet mounted around said rotatable rod which is operatively associated with a pawl that is mounted on one of the flanges, whereby undesired rotation of said rod is resisted.

4. The stretching machine of claim 3, wherein said ratchet and pawl means includes locking means.

5. The stretching machine of claim 4, wherein said belt has one end which is fixedly mounted to said seat means and a free end, said free end having means for attaching said belt to said seat means.

6. The stretching machine of claim 5, including first sidewall means mounted on said first leg platform means.

7. The stretching machine of claim 6, including second sidewall means mounted on said second leg platform means.

8. The stretching machine of claim 7, including first strap means having a first end attached to said first leg platform means and a second free end adapted to be attached to said first sidewall means.

9. The stretching means of claim 8, including second strap means having a first end attached to said second platform means and a second free end adapted to be attached to said second sidewall means.

10. The stretching machine of claim 9, wherein said first end of said first strap means is fixedly mounted to said first platform means and said second end of said first strap means includes a Velcro fastener which engages Velcro hook means mounted on said first sidewall means.

11. The stretching machine of claim 10, wherein said first end of said second strap means is fixedly mounted to said second platform means and said second end of said second strap means includes a Velcro fastener which engages Velcro hook means mounted on said second sidewall means.

* * * * *